US005400464A

United States Patent [19]

Steiner

[11] Patent Number: 5,400,464

[45] Date of Patent: Mar. 28, 1995

[54] VARIABLE HIGH/LOW VACUUM/BLOWER DEVICE

[75] Inventor: Robert E. Steiner, Chesterfield, Mo.

[73] Assignee: Emerson Electric Co., St. Louis, Mo.

[21] Appl. No.: 186,509

[22] Filed: Jan. 26, 1994

Related U.S. Application Data

[63] Continuation of Ser. No. 941,719, Sep. 8, 1992, abandoned.

[51] Int. Cl.[6] ..... A47L 9/08

[52] U.S. Cl. ..... 15/330

[58] Field of Search ..... 15/330; 417/423.2, 423.9

[56] References Cited

U.S. PATENT DOCUMENTS

| | | | |
|---|---|---|---|
| 2,049,603 | 8/1936 | Dietenberger | 15/330 |
| 3,619,850 | 11/1971 | Bolzan, Jr. | 15/330 |
| 3,906,584 | 9/1975 | Hult | 15/347 |
| 4,615,069 | 10/1986 | Henning | 15/330 |
| 4,663,799 | 5/1987 | Kiyooka | 15/330 |
| 4,694,528 | 9/1987 | Comer et al. | 15/330 |
| 4,809,394 | 3/1989 | Suka | 15/327 |
| 4,817,230 | 4/1989 | Kiyooka | 15/330 |
| 4,942,640 | 7/1990 | Hayashi | 15/319 |
| 5,023,973 | 6/1991 | Tsuchida | 15/319 |

FOREIGN PATENT DOCUMENTS 7802196 10/1979 Switzerland ..... 15/330

*Primary Examiner*—David A. Scherbel
*Assistant Examiner*—Reginald L. Alexander
*Attorney, Agent, or Firm*—Polster, Lieder, Woodruff & Lucchesi; d

[57] ABSTRACT

A variable high/low vacuum/blower device is disclosed as including an interchangeable vacuum or blower device with high pressure/low air flow or low pressure/high air flow operation. The device includes a housing having air flow channels. Air inlet and air outlet ports or openings extend through the housing and are connected to the air flow channels. Motor driven blower wheels create air flow through the air flow channels. A first valve, operable between first and second position, can selectively change the air flow in the air flow channels from high pressure/low air flow to low pressure/high air flow, while a second valve, also operable between first and second positions, can selectively change the air flow through the air inlet and air outlet ports or openings, enabling the device to operate either as a vacuum or blower device. The first valve is adjustable to variable positions from high pressure/low air flow through zero to low pressure/high air flow. The second valve is also adjustable to variable positions from maximum vacuum through zero to maximum blowing.

25 Claims, 15 Drawing Sheets

VACUUM MODE

VACUUM - SERIES MODE

FIG. 5
VACUUM - PARALLEL MODE
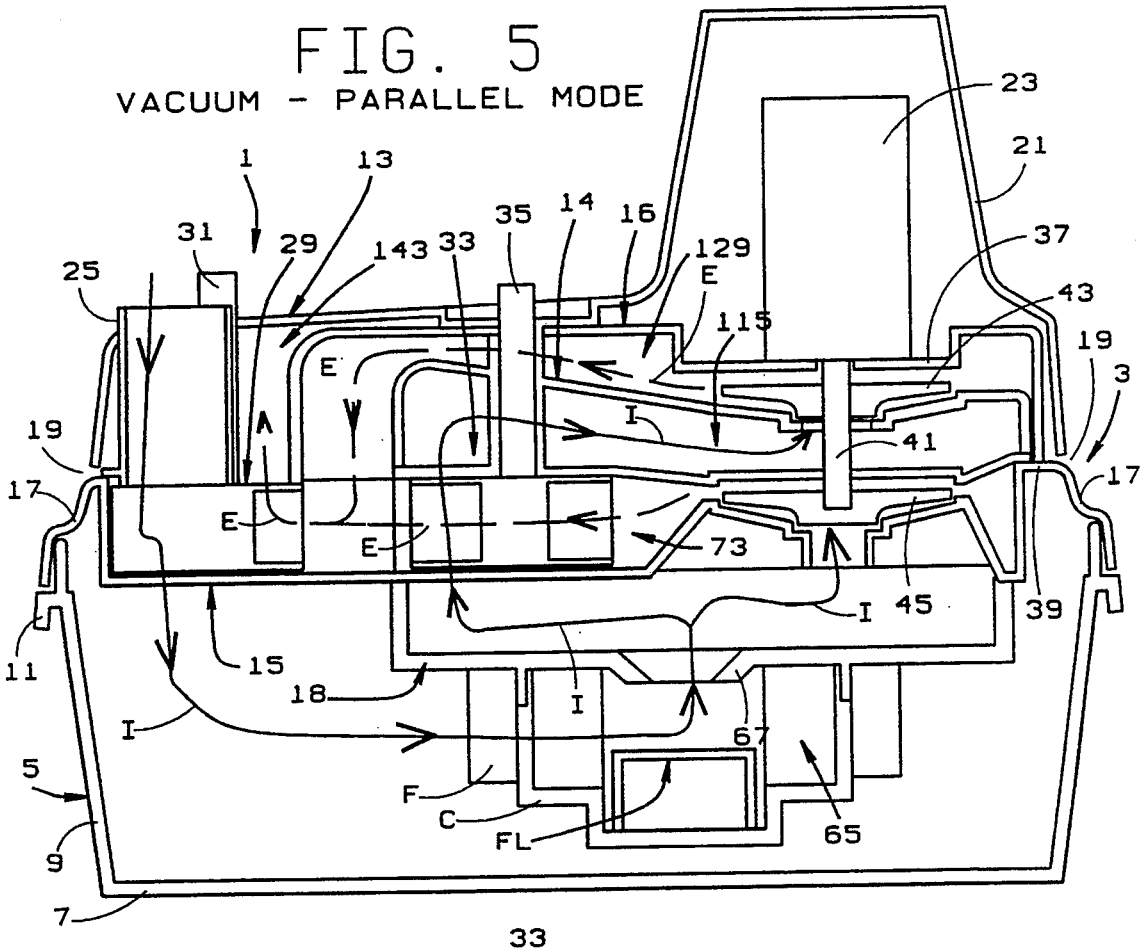
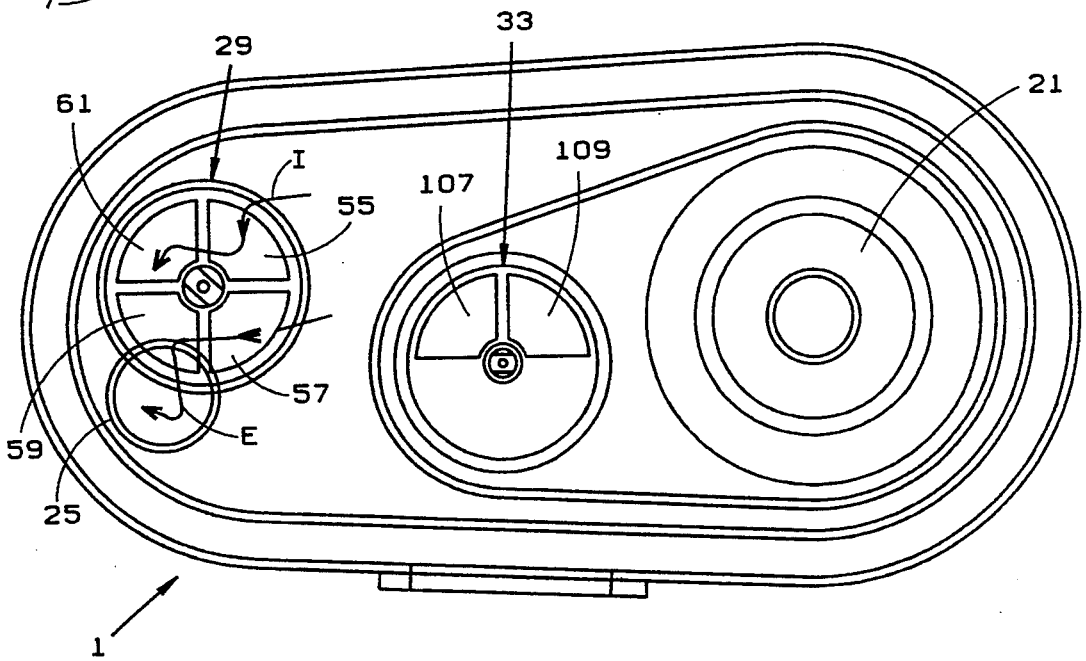
FIG. 6
BLOWER MODE

BLOWER - SERIES MODE

BLOWER - PARALLEL MODE

VACUUM MODE

VACUUM MODE

VACUUM MODE

VACUUM MODE

BLOWER MODE

BLOWER MODE

BLOWER MODE

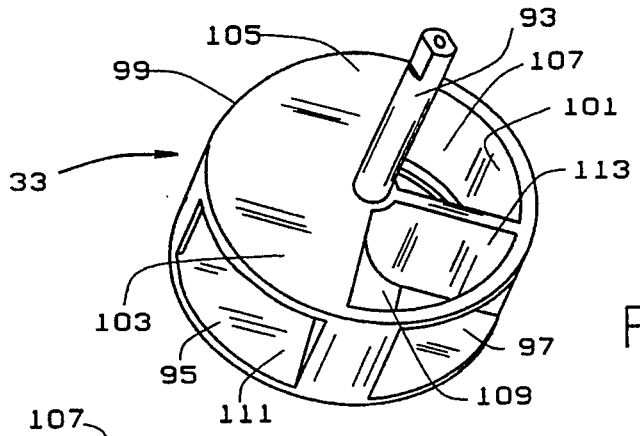
FIG. 17
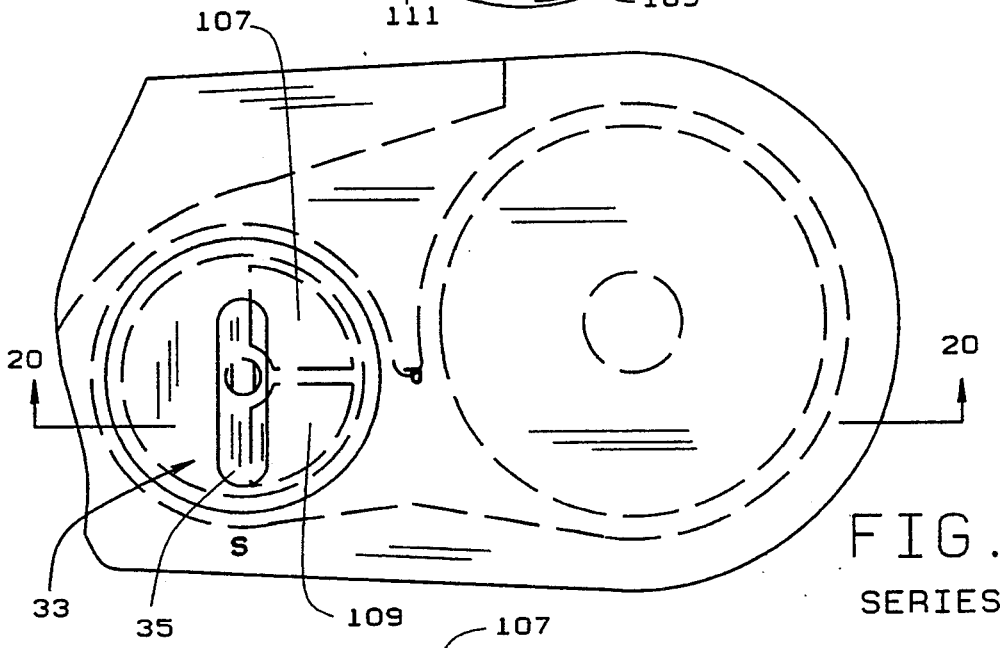
FIG. 18
SERIES MODE
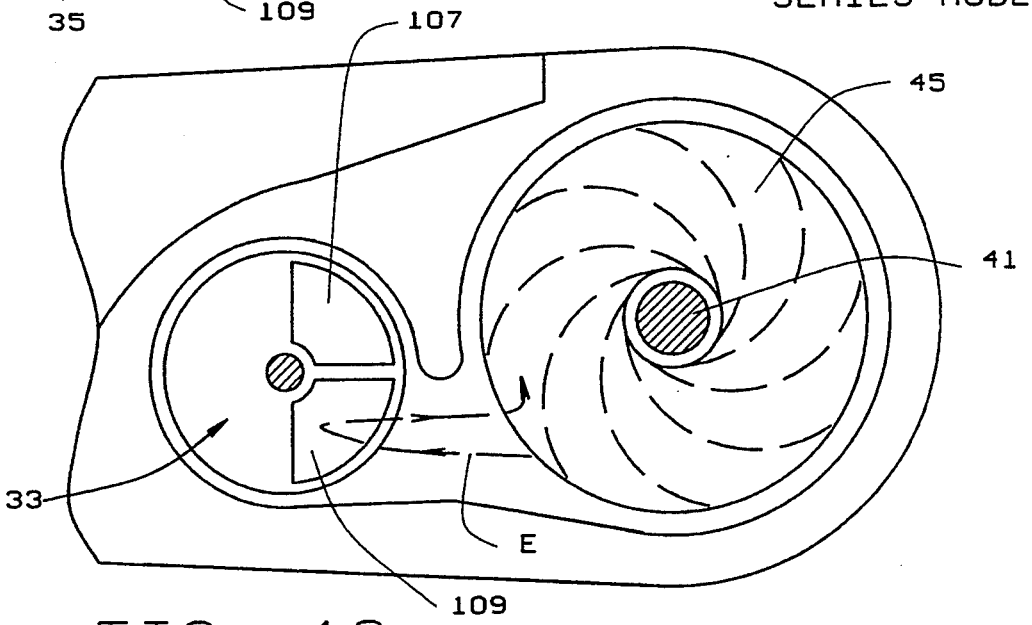
FIG. 19 SERIES MODE

SERIES MODE

PARALLEL MODE

PARALLEL MODE

PARALLEL MODE
UPPER BLOWER WHEEL

PARALLEL MODE

LOWER BLOWER WHEEL

SERIES/PARALLEL VALVE

IN SERIES MODE

IN PARALLEL MODE

VACUUM/BLOWER VALVE

IN BLOWER MODE

IN VACUUM MODE

VARIABLE HIGH/LOW VACUUM/BLOWER DEVICE

CROSS REFERENCE TO RELATED APPLICATIONS

This is a continuation application of application Ser. No. 07/941,719, filed on Sep. 8, 1992, now abandoned.

BACKGROUND OF THE INVENTION

This invention relates generally to a variable high/-low vacuum/blower device, and more specifically, to a vacuum/blower device that can be adjusted from a positive air outflow (blowing) through zero to a negative air inflow (suction). The vacuum/blower device can also be varied from a high pressure, low air flow operation through zero to a low pressure, high air flow operation. All of aforementioned functions of the vacuum/blower device operate through a single inlet/outlet port, with suitable air exhaust/intake ports or openings to work in conjunction with the single inlet/outlet port.

The first vacuum cleaner patented by Brooks in 1901 was powered by a five horsepower piston engine. While there have been many functional improvements in vacuum cleaners for economy, efficiency and ease of operation, the basic concept of vacuum cleaners has changed very little.

Basically, in the art today, a vacuum cleaner is an electrically powered fan unit designed to create an air stream moving through a pick up nozzle connected to a flexible hose. As the fan rotates, air is discharged from the periphery of the fan by centrifugal force, causing a partial vacuum at the center of the fan into which air rushes through the nozzle and hose. Where air is to be discharged in a blowing operation, the discharged air is forced out of the device, typically through a separate exhaust port. In the conventional type of vacuum cleaner where the device is used as both a vacuum and blower, the hose must be disconnected from the inlet port and connected to an outlet or exhaust port, in order to convert the device from a vacuum to a blower.

As distinct from conventional vacuum cleaner designs, the present invention is both a blower and vacuum device, while only using a single inlet/outlet port. At the same time, the vacuum cleaner of the present invention can be connected from a high pressure/low air flow operation to a low pressure, high air flow operation.

In the discussion that follows, the following background information will be of assistance in understanding the principles of the present invention. High or low pressure can be measured in inches water gauge (an instrument for measuring the amount of pressure; one inch wg=0.036 psi) or millimeters water gauge. Volume of air is measured in cubic feet or cubic meters of air displaced per minute, for example, cubic feet per minute or CFM. Thus, in the following discussion, the reference to high or low inches in terms of pressure is to be understood as referring to high or low pressure. Similarly, the reference to high or low cubic feet per minute (CFM) in terms of air displaced is also to be understood as meaning high or low air flow.

SUMMARY OF THE INVENTION

It is therefore an object of the invention is to provide a vacuum/blower device that can function either as a vacuum cleaner or as a blower through the same inlet/-outlet port.

Another object of the present invention to provide a vacuum cleaner that is selectively changeable or adjustable from a positive air outflow (blowing) through zero to a negative air inflow (suction).

Still another object of the invention is to provide a vacuum/blower device that can be selectively changed to provide blowing or suction functions using only one inlet/outlet port.

A further object of the invention is to provide a vacuum cleaner that can be selectively changed or adjusted from high pressure/low air flow operation through zero to low pressure/high air flow operation.

A still further object of the present invention is to provide an interchangeable vacuum or blower device with high pressure/low air flow or low pressure/high air flow operation.

Yet another object of the invention is to provide a vacuum/blower device where the high pressure/low air flow to low pressure high air flow is accomplished by using motor driven blower wheels along with appropriate internal valving/channel construction.

Still another object is to provide a vacuum/blower device where the change from high pressure/low air flow to low pressure/high air flow is also accomplished through the use of an independent manually operated valve mechanism.

Yet still another object of the invention is to provide a vacuum/blower device where the change from a vacuum cleaner to a blower is accomplished trough the use of another independent manually operated valve mechanism.

A further object of the present invention is to provide a vacuum/blower device that is capable of vacuuming or blowing, as may be desired, a wide and different variety of elements to be treated or disposed of, whether wet or dry.

A still further object of the invention is to provide a vacuum cleaner that is durable, efficient, economical, easy to use, and is otherwise well suited for its intended purpose.

Briefly stated, the present invention provides an interchangeable vacuum or blower device with high pressure/low air flow or low pressure/high air flow operation. The vacuum/blower device has only one inlet/outlet port where the air flow through the device can be varied from a positive air outflow (blowing) through zero to a negative air inflow (suction). The device can also be varied from a high pressure/low CFM (low air flow) operation to a low pressure/high CFM (high air flow) operation operation.

The interchangeable vacuum/blower device includes a housing with air flow channels. Air inlet/outlet means extend through the housing and are connected to the air flow channels. Means are provided for creating air flow through the air flow channels. Means are also provided for selectively changing the air flow through the air/-outlet means to provide either a vacuum or blower device, with further means being provided for selectively changing the air flow in the air flow channels from high pressure/low air flow to low pressure/high air flow operation.

The means for changing the air flow through the air inlet/outlet means includes an air inlet/outlet port and air exhaust/intake means, both of which are connected to the air flow channels and extend through the housing. The air exhaust/intake means exhaust air when air is introduced into the air inlet/outlet port for operating the device as a vacuum cleaner. The air exhaust/intake means intakes air when air is directed out through the inlet/outlet port for operating the device as a blower. Means for selectively changing the air flow in the air flow channels from high pressure/low air flow to low pressure/high air flow operation includes first valve means. Also, the means for selectively changing the air flow through the air inlet/outlet port to provide either a vacuum or blower device includes second valve means. The first and second valve means are both manually and independently operable. Each valve means has flow-through passageways operable in a first or second position.

The means for creating air flow through the air flow channels includes motor driven blower means. The first valve cooperates with the motor driven blower wheel means to provide the high pressure/low air flow or low pressure/high air flow operation. The second valve also cooperates with the motor driven blower means to change the device from a vacuum cleaner to a blower device.

The blower wheel means includes first and second blower wheels that are connected to the air flow channels and operate in conjunction with the first and second valve means to operate the device as either a vacuum or blower device with high pressure/low air flow or low pressure/high air flow operation.

These and other objects and advantages of the present invention will become apparent from the description that is to follow.

BRIEF DESCRIPTION OF THE DRAWINGS

In the drawings.

FIG. 5 is a diagrammatic sectional view of the vacuum/blower device of the present invention when operated as a vacuum cleaner in parallel mode, that is, where there is low pressure/high air flow operation;

FIG. 6 is a top plan view of the vacuum/blower device of the present invention with the upper cover or lid removed therefrom, and shown as being operated in the blower mode;

FIG. 17 is a perspective view of a series/parallel or high/low valve incorporated in the vacuum/blower device of the present invention;

FIG. 18 is a fragmentary top plan view showing the series/parallel or high/low valve when the handle or valve actuator is moved to a series or high pressure/low air flow position;

FIG. 19 is a fragmentary sectional view as viewed along lines 19—19 of FIG. 9 and illustrating the manner in which the series/parallel or high/low valve operates in conjunction with the blower wheel and air flow channels to conduct air flow therethrough;

Corresponding reference numerals will be used throughout the several figures of the drawings.

DESCRIPTION OF THE PREFERRED EMBODIMENTS

The following detailed description illustrates the invention by way of example and not by way of limitation. This description will clearly enable one skilled in the art to make and use the invention, and describes several embodiments, adaptions, variations, alternatives and uses of the invention, including what I presently believe is the best mode of carrying out the invention.

The present invention is an interchangeable vacuum/blower device. It can be operated either as a vacuum cleaner or as a blower device by the manipulation of a vacuum/blower or intake/exhaust valve for vacuum or blower operation through a single inlet/outlet. At the same time, the device, when operated as either a vacuum cleaner or blower, can also be operated with high pressure/low air flow or low pressure/high air flow by the manipulation of a series/parallel or high/low valve. This background explanation will facilitate a specific description of the present invention that follows.

Figure 1:
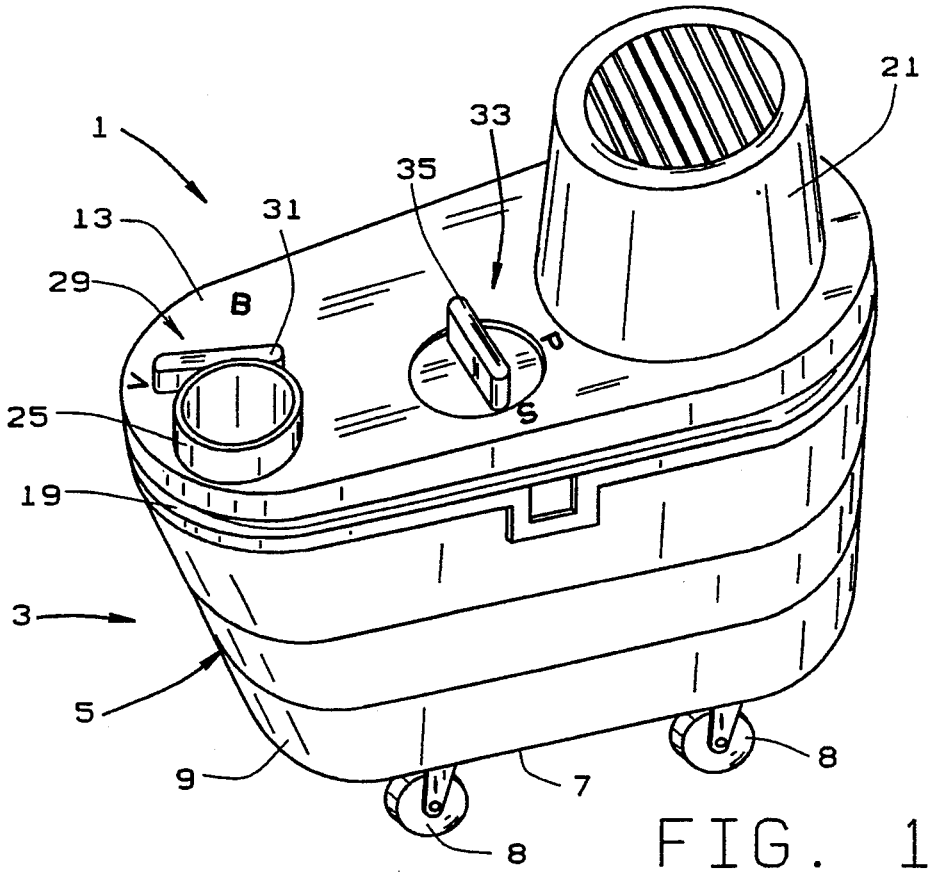
FIG. 1 is a top perspective view of the variable high/low vacuum/blower device constituting the present invention.
Figure 2:
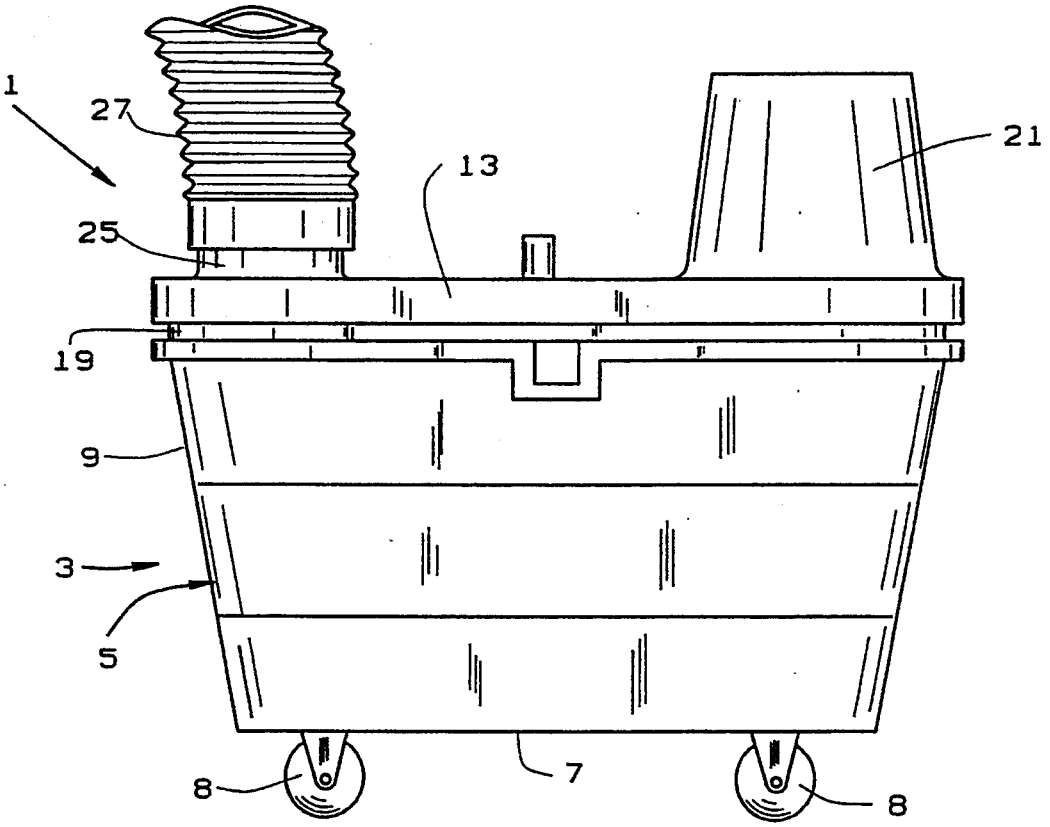
FIG. 2 is a side elevational view of the variable high/low vacuum/blower device shown in FIG. 1.
Figure 3:
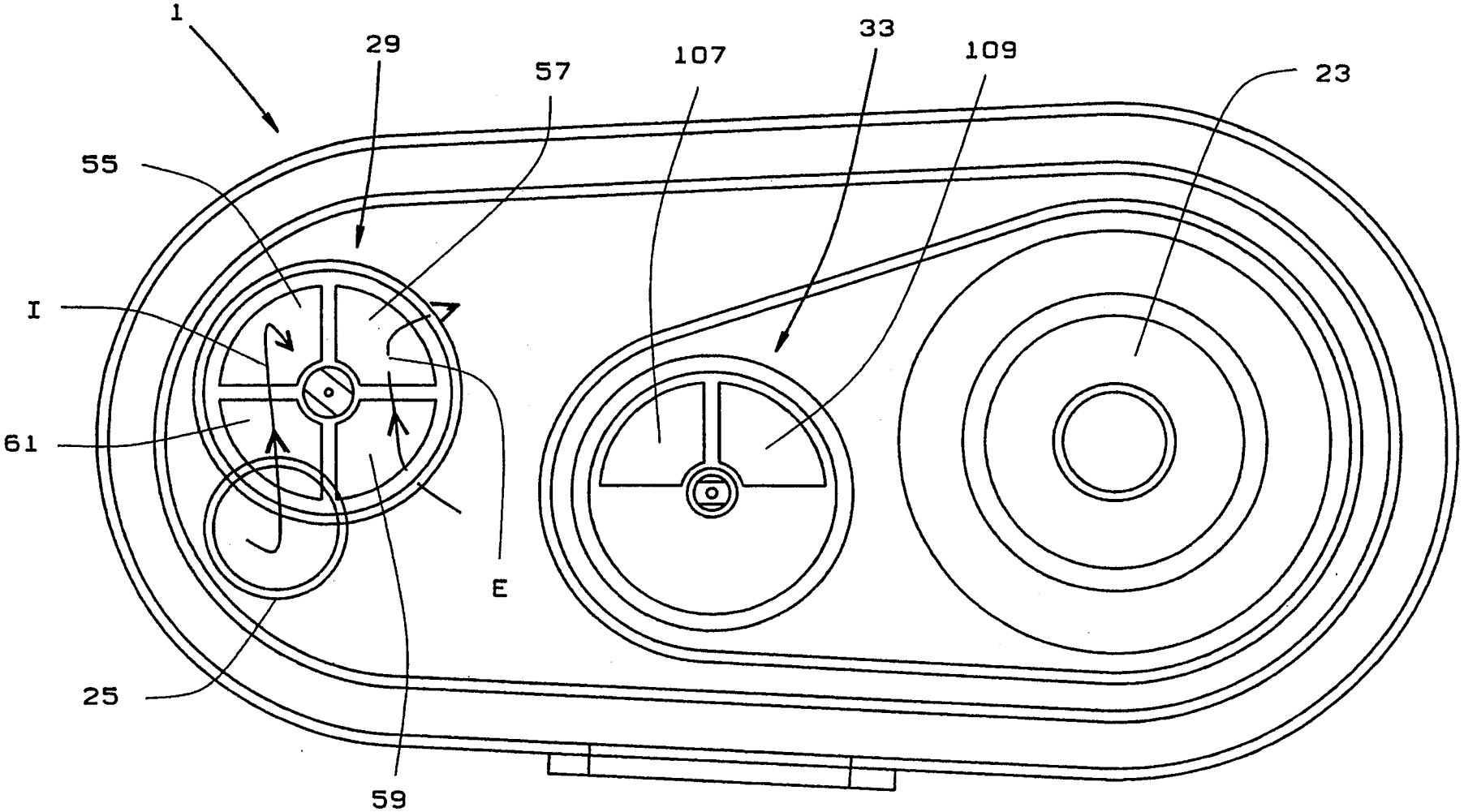
FIG. 3 is a top plan view of the variable high/low vacuum/blower device with an upper cover or lid removed therefrom, and shown as being operated in the vacuum mode.
Figure 4:
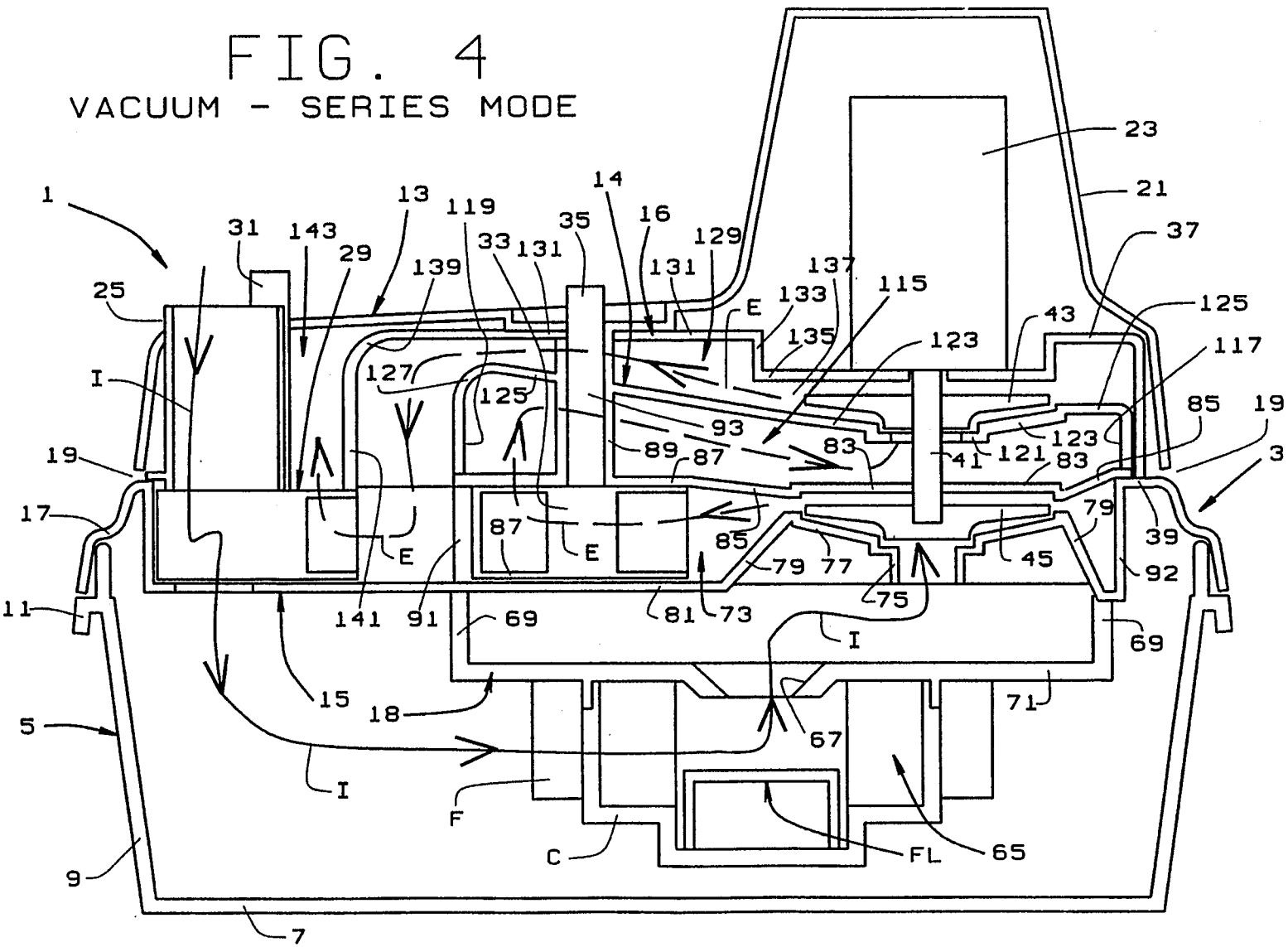
FIG. 4 is a diagrammatic sectional view of the vacuum/blower device of the present invention, when operated as a vacuum cleaner in the series mode, that is, where there is high pressure, low air flow operation.
Figure 7:
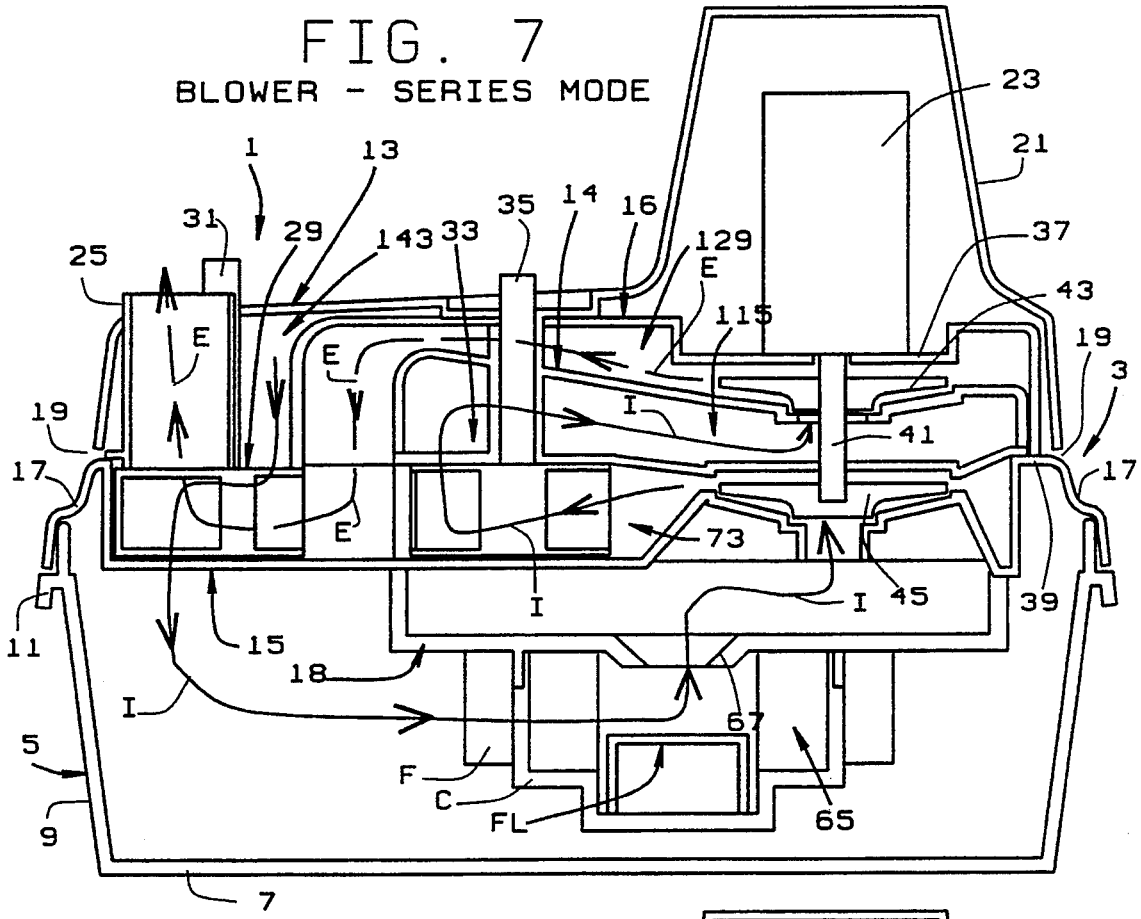
FIG. 7 is a diagrammatic sectional view of the vacuum/blower device of the present invention when operated in the blower-series mode, that is, as a high pressure/low air flow blower.
Figure 8:
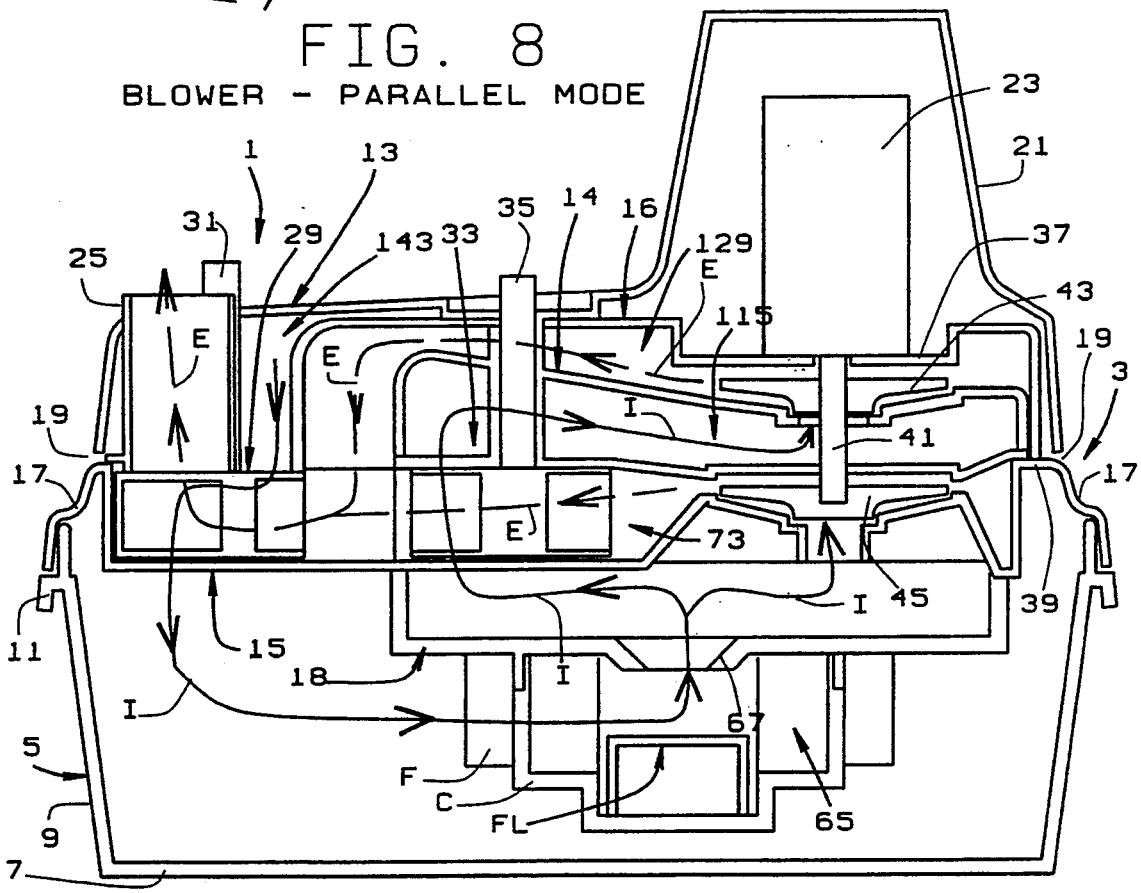
FIG. 8 is a diagrammatic sectional view of the vacuum/blower device of the present invention operated in the blower-parallel mode, that is, as a low pressure/high air flow blower.
Figure 9:
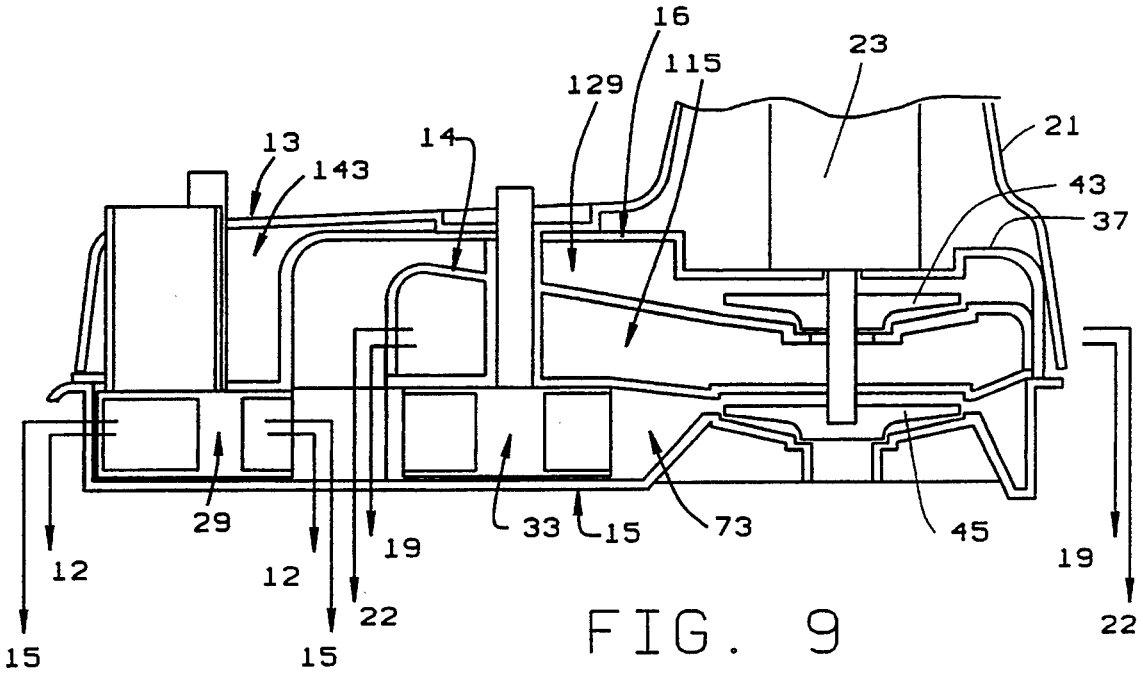
FIG. 9 is a fragmentary diagrammatic sectional view of the valve and blower mechanisms of the present invention, as mounted between the upper and lower lids or covers.

The variable high/low vacuum/blower device 1, generally shown in FIGS. 1–2 of the drawings, is illustrated in its vacuum mode in FIGS. 3–5 and in its blower mode in FIG. 6–8 of the drawings. When operated in its vacuum mode, the vacuum device can be operated in either a vacuum-series mode (high pressure/low air flow) as shown in FIG. 4 or a vacuum-parallel mode (low pressure/high air flow), as shown in FIG. 5. When operated in its blower mode, the blower device can be operated in its blower-series mode (high pressure/low air flow) as shown in FIG. 7, or in its blower-parallel mode (low pressure/high air flow) as shown in FIG. 8 of the drawings.

The overall construction of the variable high/low vacuum/blower device 1 of the present invention is best illustrated in FIGS. 1–2 of the drawings. There, it will be seen that the device 1 includes a housing 3, constructed in the embodiment illustrated as including an open ended container 5 having a bottom wall 7 with wheels 8 and an upwardly and outwardly extending side wall 9 that terminates in a rim structure 11 at its open upper end. The housing 3 further includes an upper cover 13, a lower lid 15, an intermediate and housing 14 an upper housing section 16, both extending between the upper cover 13 and lower lid 15, and a lower housing section 18 which extends below the lower lid 15. The aforesaid elements cooperate with the container 5 to support as well as contain the various components of the vacuum/blower device 1 in the housing 3. In this connection, it is to be noted that complementary rim structure 17 of the lower lid 15 cooperates with the rim structure 11 of the container 5 to provide complementary engaged and sealed relationship, as best seen in FIGS. 4–5 and 7–8 of the drawings. The upper cover 13 is, in turn, supported by the lower lid 15 at spaced locations, but preferably leaves an air exhaust/intake opening or openings 19 for drawing air into or exhausting air from the vacuum/blower components, as will be explained.

Figure 11:
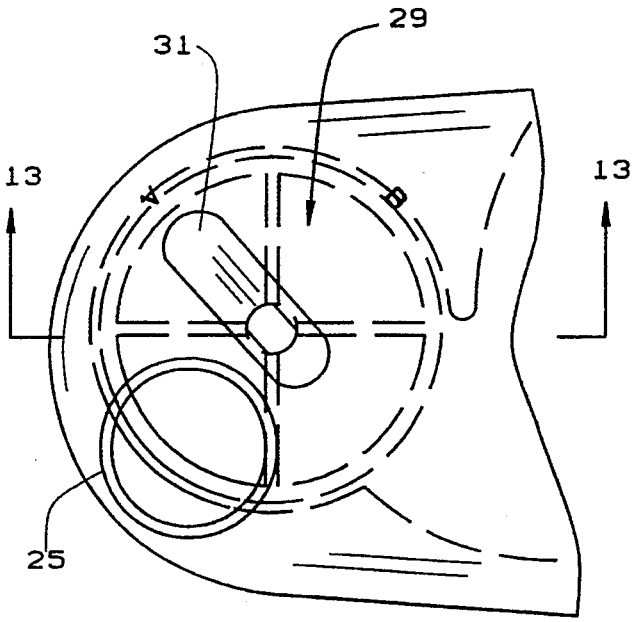
FIG. 11 is a fragmentary top plan view of the vacuum/blower or intake/exhaust valve as mounted in the vacuum/blower device of the present invention.
Figure 14:
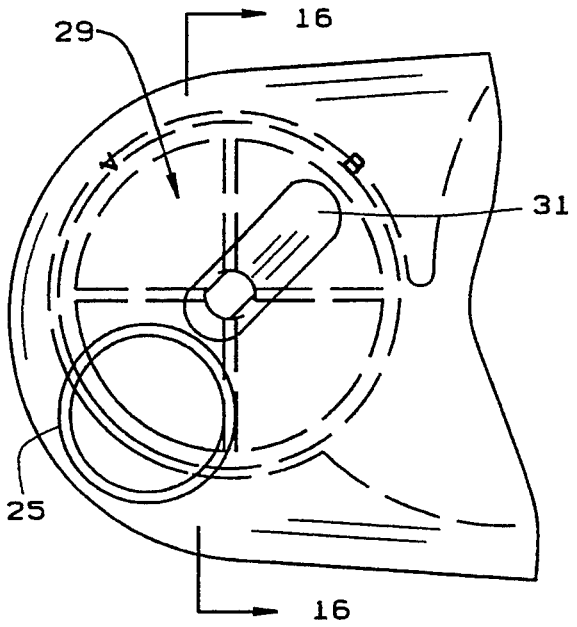
FIG. 14 is a fragmentary top plan view of the vacuum/blower or intake/exhaust valve as mounted in the vacuum/blower device of the present invention and showing a handle or valve actuator moved to a blower position for operating the vacuum/blower device as a blower.
Figure 15:
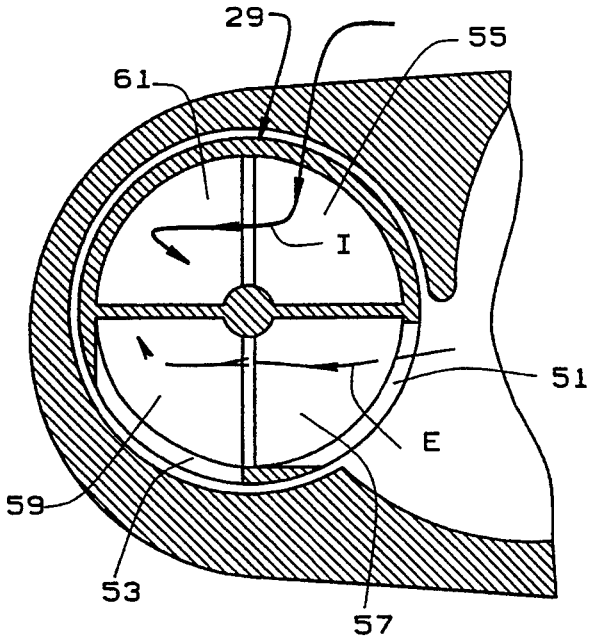
FIG. 15 is a fragmentary top sectional view as viewed along lines 15—15 of FIG. 9 and illustrating the flow of air therethrough.
Figure 16:
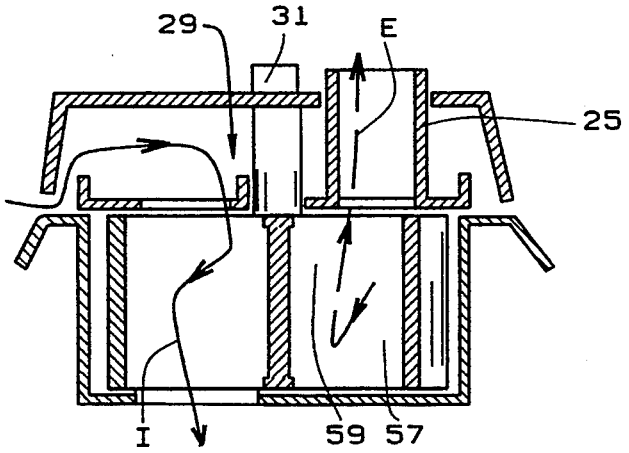
FIG. 16 is a side perspective view of the vacuum/blower or intake/exhaust valve of the present invention and further illustrating the flow of air therethrough when operated as a blower device.

As best shown in FIGS. 1–2 of the drawing, the upper cover 13 of the housing 5 includes, at the right side thereof, an integrally formed and vented motor housing dome 21 for receiving the internally mounted motor 23, as shown in FIGS. 4–5 and 7–8. The upper housing section 16 further includes, at the left side thereof, a hollow tube 25 which is attached to the upper housing section 16, the hollow tube 25 extending upwardly through an opening in the cover 13. The exterior portion of the hollow tube 25 is connected to a flexible hose 27, as is common, for operating the device as either a vacuum cleaner or blower. The hollow tube 25 extends through the upper cover 13, as indicated, and is positioned in proximity to and cooperates with the vacuum/blower or intake/exhaust valve 29, as will be explained. The vacuum/blower or intake/exhaust valve 29 includes an actuator 31 that is operable between a vacuum V or first position and blower B or second position, as illustrated in FIGS. 1, 11 and 14.

The vacuum/blower device 1 further includes a parallel/series or high/low valve 33 which is positioned closer to the motor 23 than the vacuum/blower valve 29 and includes a hand actuator 35 that extends through an opening in the upper cover 13 for operating the valve 33, between first and second positions, also to be further explained below.

With the above general description of the vacuum/blower device 1, reference is now made to FIGS. 3–24 for a specific description of the construction and operation of the variable high/low vacuum/blower device 1 of the present invention.

Reference is first made to FIGS. 3–9 for a specific construction of the components contained within the housing 5 of the vacuum/blower device 1. The motor 23 contained within the dome 21 of the upper cover 13 is supported by the motor mount 37, at the right hand side of the upper housing section 16, the motor mount 37 extending between the motor 23 and internal ledge 39 of the lower lid 15. The motor 23 includes a depending drive shaft 41 on which upper and lower blower wheels 43, 45, respectively are mounted. The upper and lower blower wheels 43, 45 are operated to create air flow in air flow channels constructed in and between the upper cover 13 and lower lid 15, as will be described. The upper and lower blower wheels 43, 45 may be constructed in any manner desired, for example, with a specific number of fan blades, at predetermined angular configurations, etc., in order to provide the amount of air flow desired, as is well known. The upper and lower blower wheels 43, 45 communicate with the air flow channels, to be described, as well as the vacuum/-blower valve 29 and the high/low valve 33, to provide the desired vacuum or blowing action with either high or low pressure, as desired.

In order to understand the construction and operation of the air flow channels in conjunction with the upper and lower blower wheels 43, 45 and the valves 29, 33, reference is made to FIGS. 3–5, 11–13 and 18–36 of the drawings. These figures illustrate the operation of the vacuum/blower device 1 in its vacuum mode, whether operated in either a series mode (high pressure/low air flow) or parallel mode (low pressure/high air flow).

Figure 10:
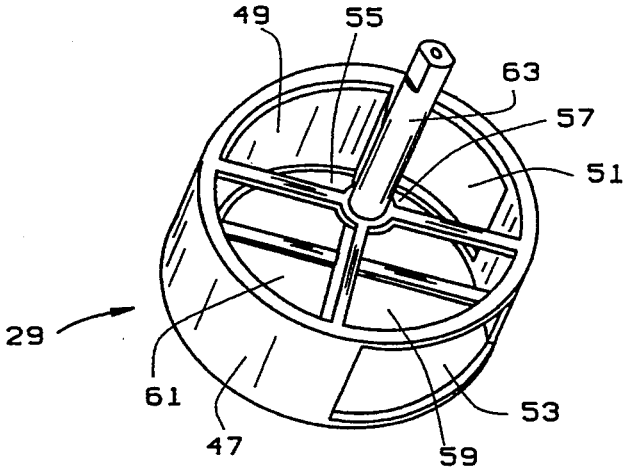
FIG. 10 is a perspective view of a vacuum/blower or intake/exhaust valve used in the present invention.

When the actuator 31 of the vacuum/blower valve 29 is moved to the V position as shown in FIGS. 1 and 11, the vacuum/blower valve 29 is opened to allow air to be introduced into the hollow tube 25 and then through the vacuum/blower valve 29. Note in the FIG. 10 illustration of the vacuum/blower valve 29 (without the actuator 31), that the vacuum/blower valve 29 has an injection molded design with a series of open and closed lateral and vertical quadrants. The open lateral and vertical quadrants constitute flow-through passageways which enable the vacuum/blower valve 29 to communicate with the hollow tube 25 and the interior of the housing 5. As shown in FIGS. 10–11 and 31–36 of the drawings, there are two lateral closed quadrants 47, 49 and two open lateral quadrants 51, 53. Each of the four vertical quadrants 55, 57, 59 and 61 are open, as illustrated. Reference to FIGS. 31–36 will further illustrate the position of the open and closed lateral quadrants, 47, 49, 51 and 53, and the open vertical quadrants, 55, 57, 59 and 61, when operated in either the blowing or vacuum made. A stem 61 connects the interconnected web and closed/open quadrant structure of the vacuum/blower valve 29, with the stem 63 also supporting the actuator 31 at its upper outer end, as shown in FIGS. 1 and 11.

Figure 12:
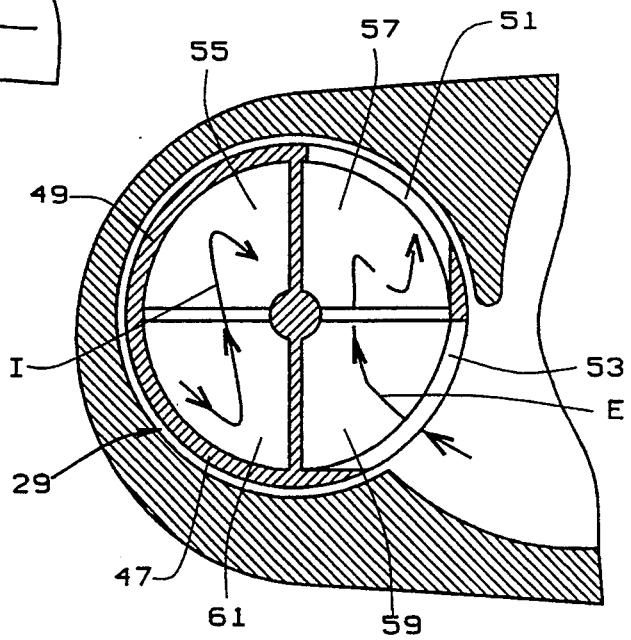
FIG. 12 is a sectional view of the vacuum/blower or intake/exhaust valve as viewed along line 12—12 of FIG. 9 and showing the air flow therethrough.
Figure 13:
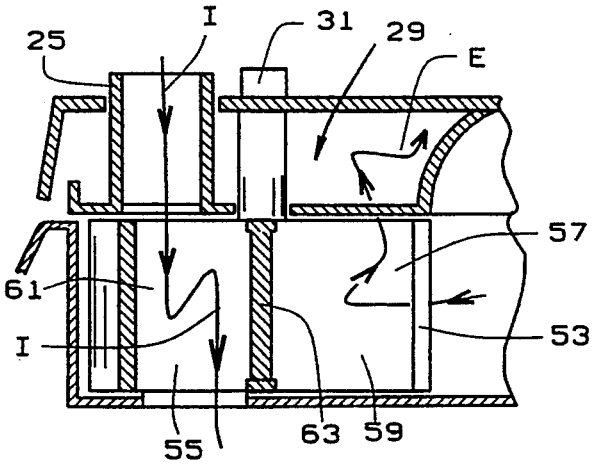
FIG. 13 is a side elevational sectional view of the vacuum/blower or intake/exhaust valve as mounted in the vacuum/blower device of the present invention and also showing air flow therethrough.

As best seen in FIGS. 10–13 of the drawings, when the vacuum/blower valve 29 is turned to the V or vacuum position, air is introduced into the open quadrants 61 and 55, constituting a first flow-through passageway, and then is introduced into the body of the container 5, as represented by the intake arrows I. At the same time, exhausted air E emanates from the air flow channels in the container 5 through a second flow-through passageway in vacuum/blower valve 29 defined by lateral quadrant 53 and vertical quadrants 59 and 57, as shown in FIG. 12.

Once inside the container 5, the intake air I is drawn by lower blower wheel 45 through an air filter F mounted in the container 5. Note that the air filter F is mounted in a filter cage C, the latter also supporting a float FL for wet operation of the device, as is known in the art.

Following air filter cleaning of the intake air I, the air is drawn by the lower blower wheel 45 into a lower air channel 65 having a through opening 67 therein. The lower air channel 65 is constructed to extend below, while communicating with the lower blower wheel 45 and the high/low valve 33 in the vacuum-series mode shown in FIG. 4 of the drawing. The lower air flow channel 65 is constructed with a downwardly extending side wall 69 and a lower bottom wall 71, the latter having the through opening 67 formed in a central location thereof. The downwardly extending side wall 69 and bottom wall 71 are preferably designed to extend below the lower lid 15 within the container 5, as is illustrated, forming the lower housing section 18 previously described.

Once the vacuum or intake air I passes through the opening 67 in the bottom wall 71 of the lower air flow channel 65, it is drawn through the lower blower wheel 45 as is shown in FIG. 4. In the vacuum-series mode illustration of FIG. 4, the air is then exhausted from the lower blower wheel 45 into a lower intermediate air flow channel 73 for communication with the high/low valve 33. For this purpose, note that the lower lid 15 has a cylindrical collar 75, immediately below the lower blower wheel 45, into which the vacuum or intake air I is introduced for communication with the lower blower wheel 45. The cylindrical collar 75 is integrally connected to an inverted frusto-conical section 77 generally corresponding in shape, but larger than the lower blower wheel 45, for substantially the entire width thereof. The inverted frusto-conical section 77 is, in turn, integrally connected to a larger right-side-up frusto-conical section 79, the lower margin of which is connected to a generally horizontally extending bottom section 81 of the lower lid 15. The above described elements form not only the upper wall of the lower air flow channel 65, but also the lower wall of the lower intermediate air flow channel 73.

The upper wall section forming the lower intermediate air flow channel 73 is part of the intermediate housing 14 and includes a generally horizontally extending upper wall section 83 through which the rotating shaft 41 of the motor 23 extends and an inverted frusto-conical section 85 which is connected at an outer end thereof. At the left side of the outer end of the inverted frusto-conical section 85 (as seen in FIG. 4), there is a horizontally extending surface 87 with a collar section 89 vertically extending upwardly therefrom for receiving the stem of the valve 33. To complete the lower intermediate air flow channel 73, a vertically extending wall 91 from the lower lid 15 extends between the horizontally extending wall 87 and bottom section 81 on the left side of the intermediate housing 14 as seen in FIG. 4, while a vertical wall 92 of the lower lid 15, between the inverted frusto-conical section 85 and the right-side-up frusto-conical section 79, can be seen on the right side in FIG. 4.

It is to be noted that the body of the series/parallel or high/low valve 33 is located between the bottom section 81 of the lower air flow channel 65 and the horizontally extending surface 87 forming part of the upper wall of the lower intermediate air flow channel 73. The stem 93 of the series/parallel or high/low valve 33 extends upwardly through the cylindrical collar 89 and is connected at its upper end, to the actuator 35, as illustrated.

The construction of the series/parallel or high/low valve 33 is best shown in FIG. 17 of the drawings. There, it will be seen that the valve 33 has an interconnected web and open/closed quadrant structure in an integrally molded design similar to the vacuum/blower valve 29, but having different open and closed quadrants. The open quadrants form flow-through passageways which allow flow of air therethrough in the series and parallel positions of the valve 33. Specifically, note that there are three open lateral quadrants 95, 97 and 99 and one closed lateral quadrant 101. There are also two closed vertical quadrants 103, 105, one partially open vertical quadrant 109 and one open vertical quadrant 107. However, note that there is a bottom wall 111 which prevents vertical air flow except through the vertical quadrant 107 and a vertical wall separator 113 which permits lateral air flow through the lateral quadrants 95, 99, with vertical air flow also through the vertical quadrant 109 because of the open quadrant communication between the open lateral quadrant 97 and the open vertical quadrant 109. Reference to FIGS. 25–30 will further illustrate the position of the three open lateral quadrants 95, 97 and 99 and one closed lateral quadrant 101, as well as the two closed vertical quadrants 103, 105, one partially open vertical quadrant 109 and one open vertical quadrant 107, the series or parallel operation of the series/parallel valve 33.

The manner in which the open and closed quadrants of the series/parallel or high/low valve 33 is used in the vacuum/blower device 1 will be further explained below. For the purpose of the present discussion, it is important to note that the open and closed quadrants of the series/parallel or high/low valve 33 are located in the lower intermediate air flow channel 73, with the stem 93 extending upwardly through the cylindrical collar 89, as is illustrated in FIGS. 4–5, 7–9, 20 and 23–24.

The intermediate housing 14 forms the upper intermediate air flow channel 115, thus having the aforementioned upper elements of the lower intermediate air flow channel 73 also forming the bottom wall thereof. This includes the horizontal section 83, the inverted frusto-conical section 85, horizontally extending surface 87, with the cylindrical collar 89 extending upwardly therefrom. At the right side of the upper intermediate air flow channel 115, the inverted frusto-conical section 85 is connected to a vertical wall section 117, while the left side of the upper intermediate air flow channel 115 is connected to a vertical wall section 119. Both the right and left upper vertical wall sections 117, 119 of the upper intermediate air flow channel 115 are integrally connected to upper wall portions to define the upper intermediate air flow channel 115. Specifically, this includes horizontal wall section 121 through which the motor shaft 41 extends in an inverted frusto-conical section 123, generally complementary to, but larger than the shape of the upper blower wheel 43. On the right side of the upper intermediate air flow channel, the inverted frusto-conical wall section 123 extends for only a small distance and is then connected to a horizontal wall section 125 which, in turn, is connected to the vertical wall section 117. On the left side of the upper intermediate air flow channel 115, the inverted frusto-conical section 123 extends between the horizontal section 121 through the cylindrical collar 89 and is joined to a curvilinear wall section 127 that interconnects the left vertical wall section 119 and the left hand side of the upper inverted frusto-conical section 123. All of these just described elements form the upper air flow channel 115 within the confines of the intermediate housing 14.

Above the upper intermediate air flow channel 115, there is an upper air flow channel 129. As in the other air flow channels, the upper air flow channel 129 has the just described elements of intermediate housing 14 forming the intermediate air flow channel 115, which serve as the upper wall thereof, also serving as the bottom wall areas of the upper air flow channel 129. The cylindrical collar 89, in addition to extending between the upper air flow channel 115, also extends up into the air flow channel 129. An upper horizontal wall 131, forming part of the upper air flow channel 129, extends on opposite sides of the cylindrical collar 89 and is connected, on the right side in FIG. 4, to a depending vertical wall 133, with a lower horizontal wall 135 forming the motor mount 37 upon which the motor 23 rests. The lower horizontal wall 135 is spaced upwardly from the inverted frusto-conical wall section 123 to define an opening 137 from which exhaust air is emitted from the upper blower wheel 43. On the left hand side of the upper air flow channel 129, as viewed in FIG. 4, the upper horizontal wall 131 is connected to a curvilinear wall section 139 which is, in turn, connected to a vertical wall section 141. The vertical wall section 141 terminates short of the body of the vacuum/blower valve 29, exposing the lateral quadrants of the vacuum/blower valve 29 to the upper air flow channel 129.

The last air flow channel to be described is the upper left side air flow channel 143 which extends between the just described wall section 131, 139 and 141 of the upper air flow channel 129 and the upper cover 13, in order to enable air to be exhausted or introduced through the air exhaust/intake opening or openings 19 between the upper cover 13 and the lower lid 15.

From the above discussion, it will be seen that there is a lower air flow channel 65, a lower intermediate air flow channel 73, an upper intermediate air flow channel 115, an upper air flow channel 129 and an upper left side air flow channel 143, all of which communicate with the vacuum/blower or intake/exhaust valve 29, the series/parallel or high/low valve 33 and the upper and lower blower wheels 43, 45 in directing air in and through the vacuum/blower device 1 of the present invention.

For a description of the above described components in connection with the various operating modes of the vacuum/blower device 1, reference is first made to FIGS. 3–5, 11–13, 18–24 and 34–36 of the drawings for a description of the vacuum mode of operation. For this purpose, the vacuum/blower or intake/exhaust valve 29 is operated by the actuator 31 for alignment with the vacuum V position of the valve 29, as best seen in FIG. 11 of the drawings. With the electric motor 23 driving the upper and lower blower wheels 43, 45, respectively, intake air I is introduced or drawn into the hollow tube 25, as represented by the solid line intake arrows I. The intake air I is then directed into the body of the container 5 and passed through the filter F, as best seen in FIG. 4 of the drawings. Any dirt or debris pulled in by the vacuum is deposited into the container 5, as is well known. The solid arrow intake air I is introduced directly into the lower blower wheel 45, when operated in the vacuum-series mode as shown in FIG. 4 of the drawings, or is split between the lower blower wheel 45 and a separate passageway through the series/parallel or high/low valve 33, when operated in the vacuum-parallel mode as shown in FIG. 5 of the drawings.

First referring to the vacuum-series mode of operation shown in FIG. 4, the intake air I, after it passes through the lower blower wheel 45, is then exhausted as exhaust air E, represented by the dotted line arrows, which passes through the series/parallel or high/low valve 33, the various air flow channels, and finally through the vacuum/blower or intake/exhaust valve 29.

Figure 20:
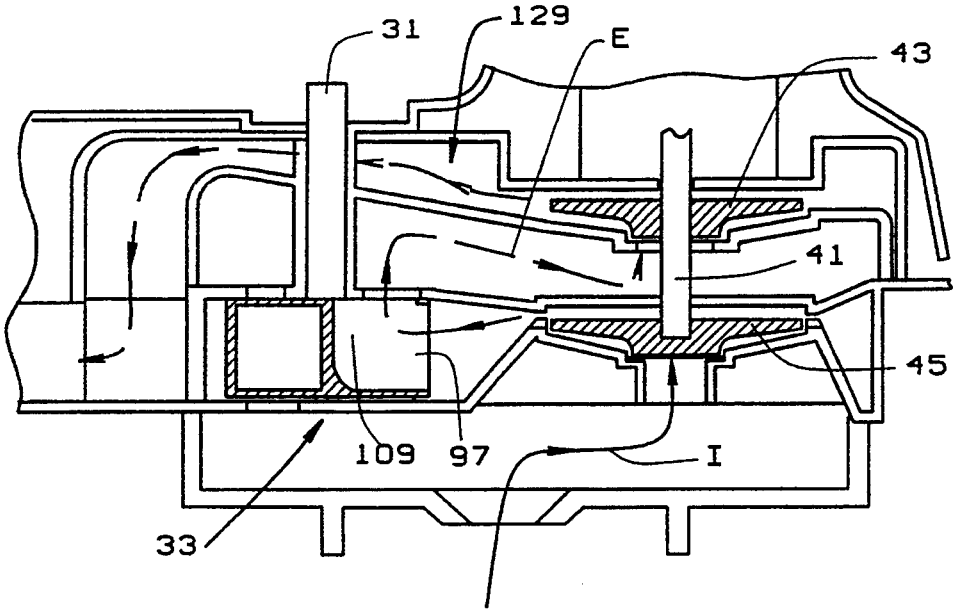
FIG. 20 is a fragmentary sectional view as viewed along lines 20—20 of FIG. 18 when the series/parallel or high/low valve is operated in a series or high pressure/low air flow condition, and further illustrating the air flow between the blower wheels, air flow channels and the series/parallel or high/low valve.
Figure 21:
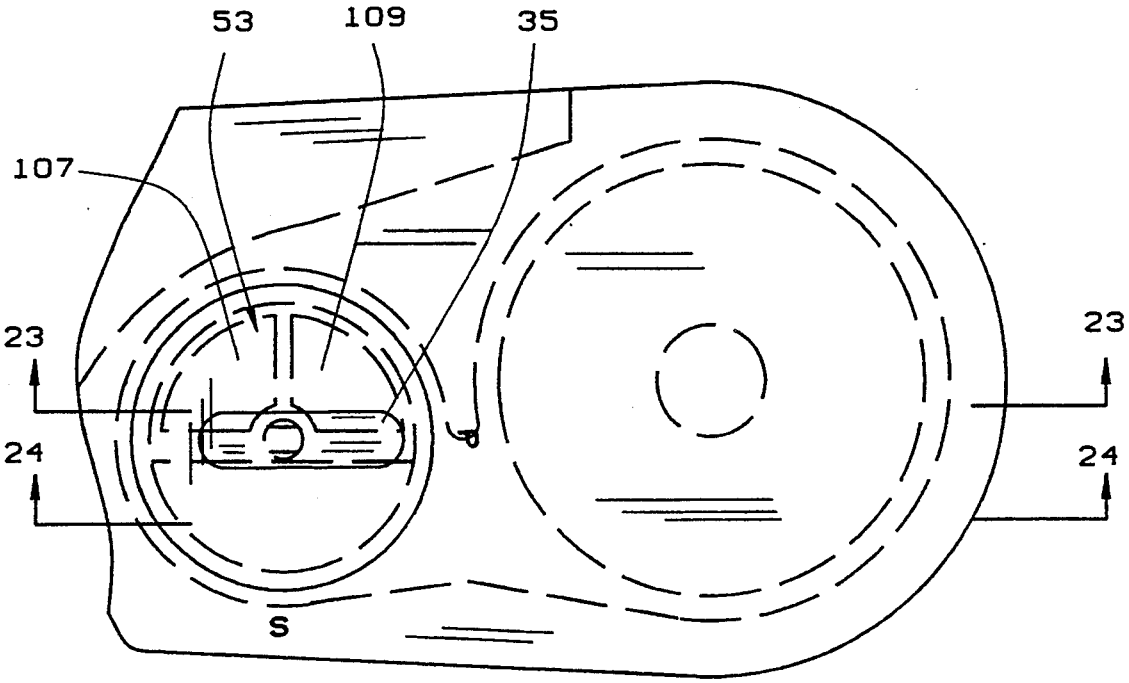
FIG. 21 is a fragmentary top plan view of the series/parallel or high/low valve when operated in the parallel or low pressure/high air flow position.
Figure 22:
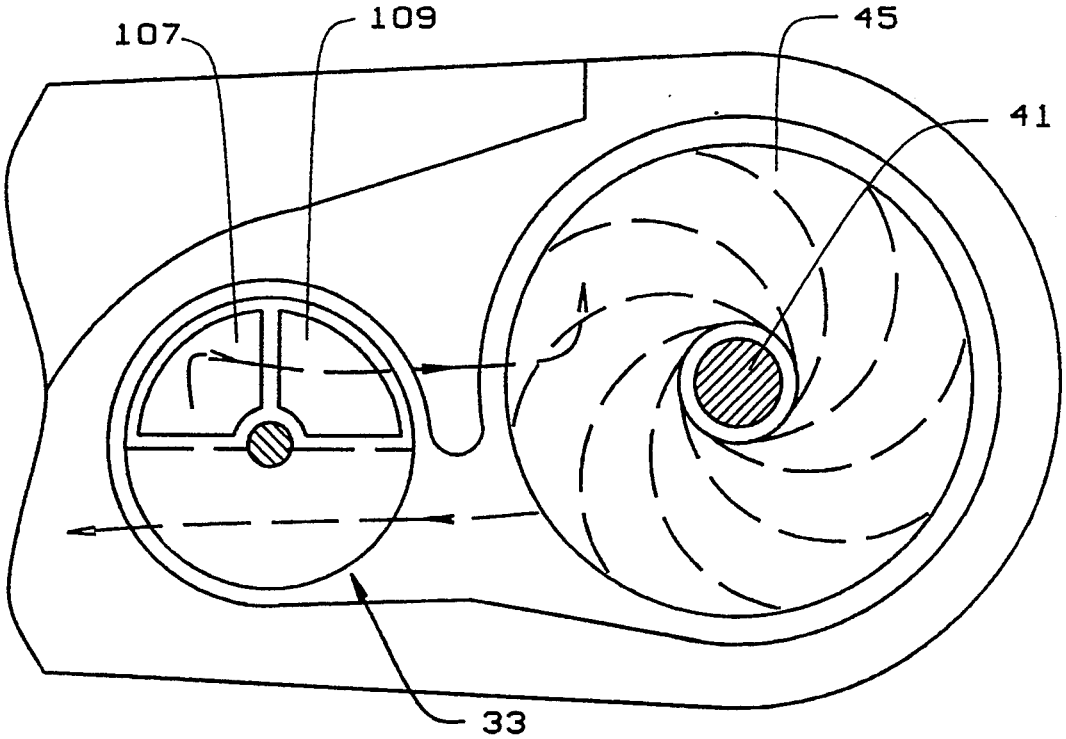
FIG. 22 is a sectional view of the series/parallel or high/low valve in proximity to the blower wheels, as viewed along lines 22—22 of FIG. 9, and showing the flow of air therethrough.

In the vacuum-series mode of operation as shown in FIG. 4 of the drawings, as well as FIGS. 19–20 which show the exhaust air E air flow through the series/parallel or high/low valve 33, it will be seen that exhaust air passes through the laterally open quadrant 97 and the vertically open quadrant 109 of the valve 33 (see FIGS. 19–20), constituting a first flow-through passageway, for entry of the exhaust air E into the upper intermediate air flow channel 115. Exhaust air E is then directed into the upper blower wheel 43, which subsequently redirects the exhaust air E into the upper air flow channel 129, as best seen in FIGS. 4 and 20. From the upper air flow channel 129, the exhaust air E is then exhausted through the opened lateral quadrant 53 and the upper vertical quadrants 59, 57, constituting the second flow-through passageway of the vacuum/-blower or intake/exhaust valve 29, in order to allow the exhaust air E to pass into the upper left hand side air flow channel 143, for final evacuation through the exhaust openings 19 between the upper cover and lower lid 13, 15, respectively.

In the vacuum-series mode of operation shown in FIG. 4 of the drawings, it will be appreciated that a high pressure/low air flow will result from operating the series/parallel or high/low valve in the series or high position, due to the use of both upper and lower blower wheels 43, 45 in this mode of operation. In other words, higher pressure results from the use of both upper and lower blower wheels where the air flow is directed through a single pathway, rather than a split pathway, as in the parallel mode of operation.

When operated in the vacuum-parallel mode as shown in FIG. 5, the intake air I, after passing through the filter F and the lower opening 67 in the lower air flow channel 65 is divided into two separate pathways, one of which is directed through the lower blower wheel 45 and then through the series/parallel or high/-low valve 33 through certain air flow channels to the atmosphere. The second pathway or second flow-through passageway directs the intake air I through the series/parallel or high/low valve 33 as intake air I into the upper blower wheel 43, from where it is exhausted as exhaust air E through the upper air flow channel 129, the vacuum/blower valve 29, and then to atmosphere.

Independent of intake air being introduced to the upper and lower blower wheels, the series/parallel or high/low valve 33 also enables exhaust air E to be directed through a third flow-through passageway thereof. Specifically, as shown in FIG. 5, 22, 24 and 28–30 of the drawings, the series/parallel or high/low valve 33, in parallel mode, enables exhaust air E emanating from the lower blower wheel 45 to be directed through the lateral quadrants 99, 95 thereof directly into the upper air flow channel 129, and then be exhausted through the vacuum/blower or intake/exhaust valve 29 into the upper left hand side air flow channel 143 to atmosphere. The upper blower wheel 43 draws air through the high/low valve 33 from air channel 65 through vertical quadrant 107, which continues into and through the upper blower wheel 43. It then becomes exhaust air E and follows the air flow channels 129 and 143, as previously described.

Figure 23:
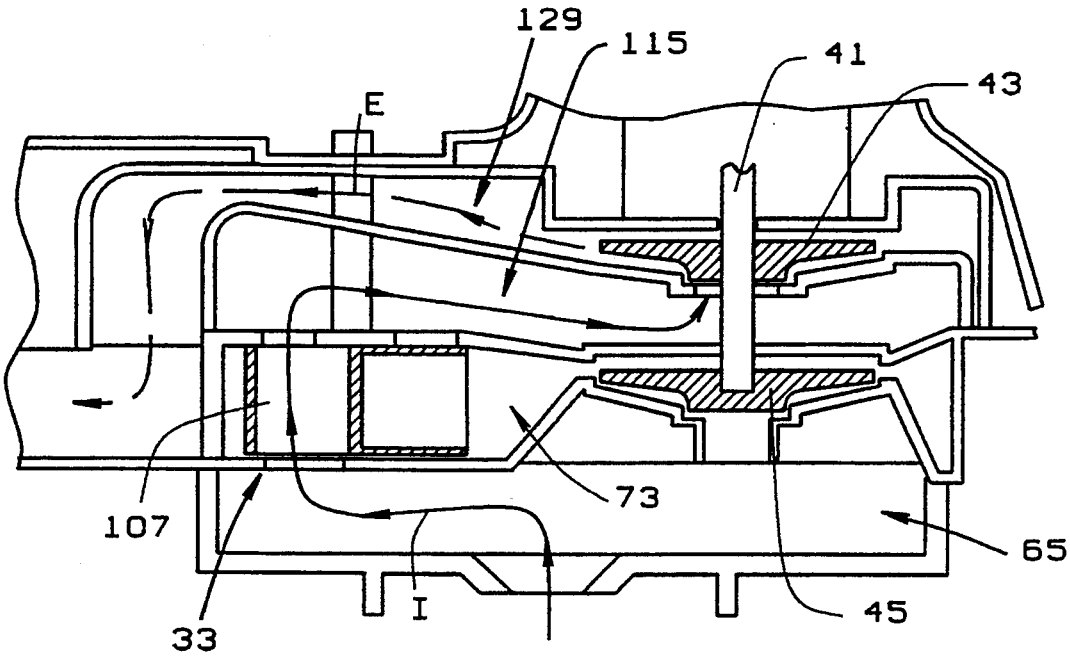
FIG. 23 is a fragmentary sectional view as viewed along line 23—23 of FIG. 21 and showing a secondary parallel air path through the series/parallel or high/low valve to the upper blower wheel, including the air flow therethrough.
Figure 24:
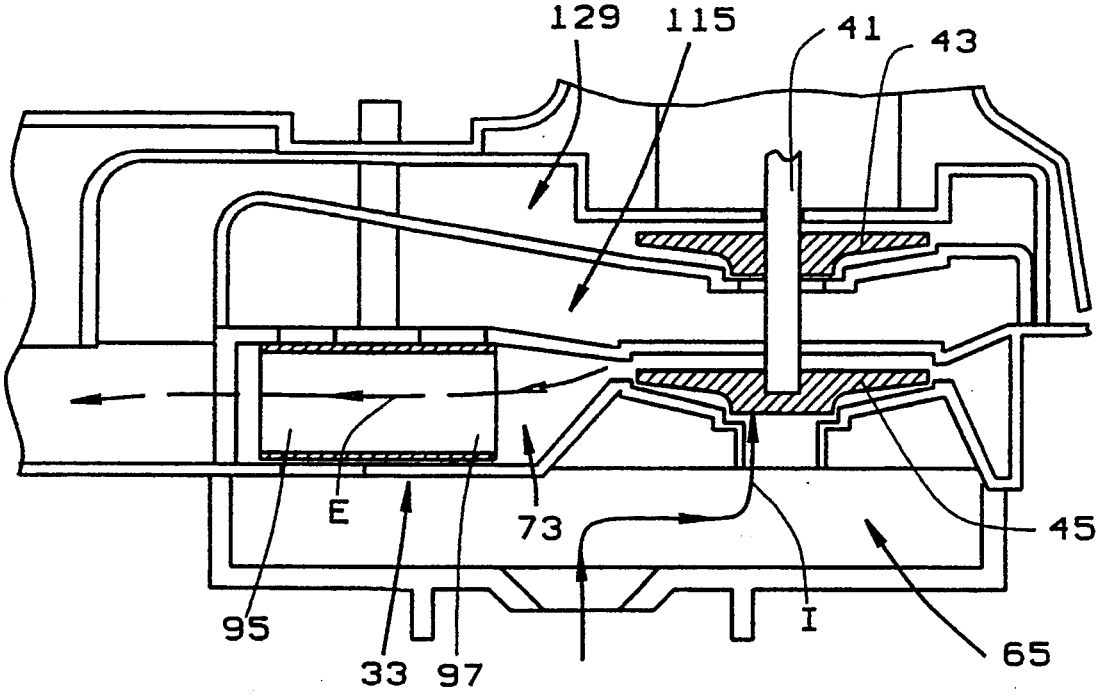
FIG. 24 is a fragmentary sectional view as viewed along lines 24—24 of FIG. 21 and illustrating a primary parallel air path through the lower blower wheel and the series/parallel or high/low valve of the present invention.
Figure 25:
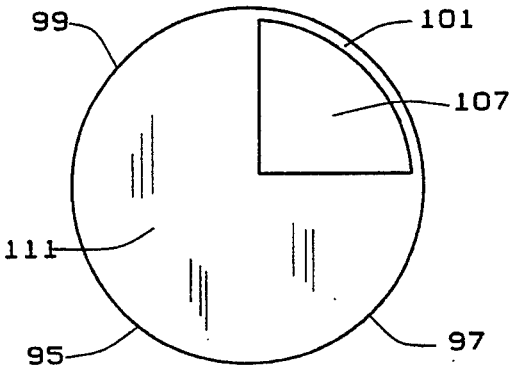
FIG. 25 is a bottom plan view of the series/parallel or high/low valve in series or high pressure/low air flow operation.
Figure 28:
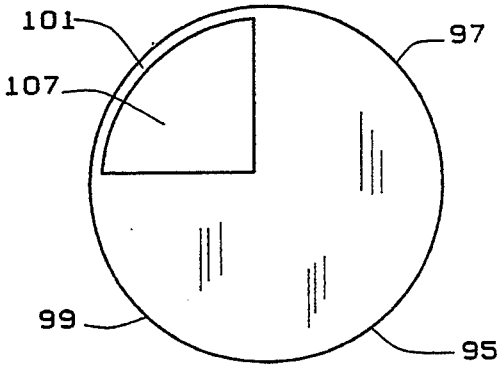
FIG. 28 is a bottom plan view of the series/parallel or high/low valve in parallel or low pressure/high air flow operation.
Figure 26:
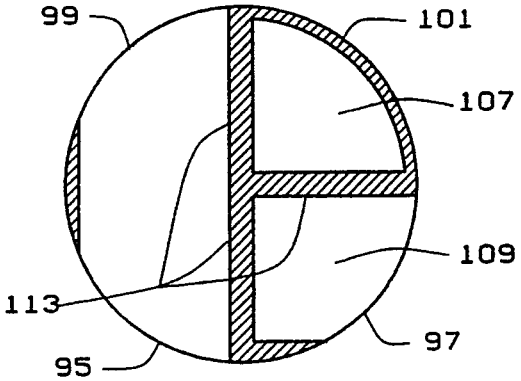
FIG. 26 is an intermediate cross sectional view of the series/parallel or high/low valve in series or high pressure/low air flow operation.
Figure 29:
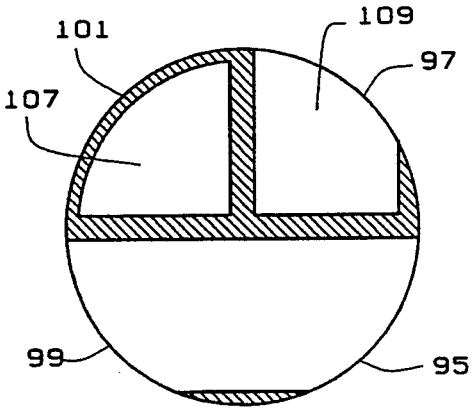
FIG. 29 is an intermediate cross sectional view of the series/parallel or high/low valve in parallel or low pressure/high air flow operation.
Figure 27:
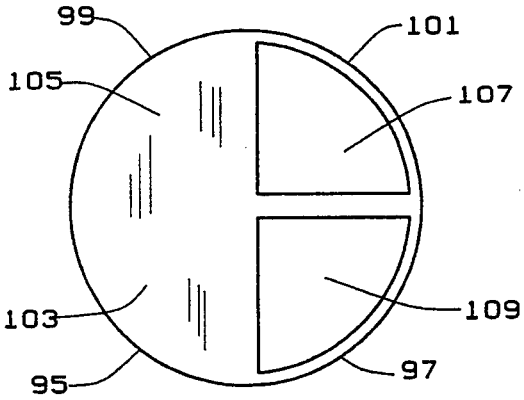
FIG. 27 is a top plan view of the series/parallel or high/low valve in series or high pressure/low air flow operation.
Figure 30:
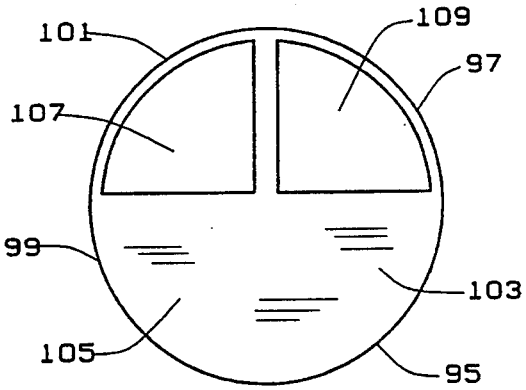
FIG. 30 is a top plan view of the series/parallel or high/low valve in parallel or low pressure/high air flow operation.
Figure 31:
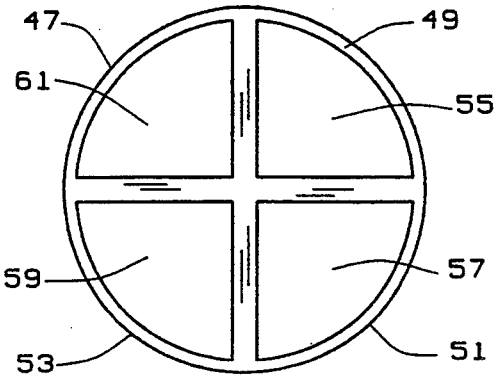
FIG. 31 is a bottom plan view of the vacuum/blower valve in blowing operation.
Figure 34:
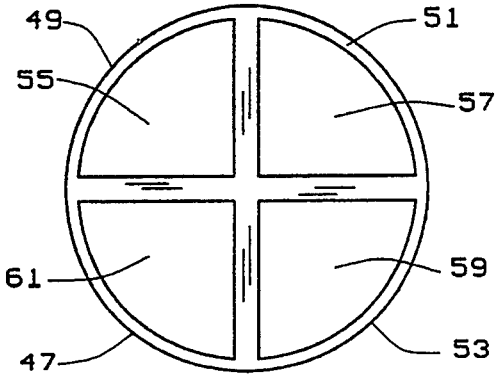
FIG. 34 is a bottom plan view of the vacuum/blower valve in vacuum operation.
Figure 32:
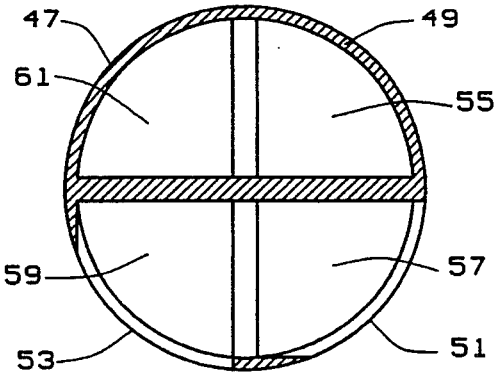
FIG. 32 is an intermediate cross sectional view of the vacuum/blower valve in blowing operation.
Figure 35:
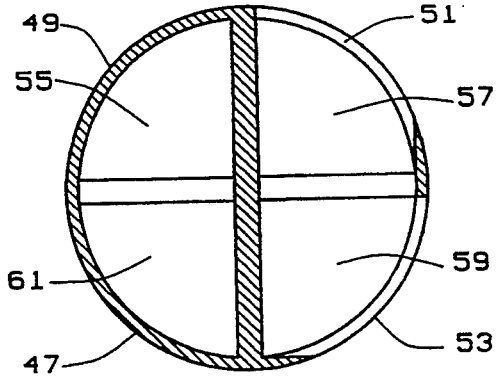
FIG. 35 is an intermediate cross sectional view of the vacuum/blower valve in vacuum operation.
Figure 33:
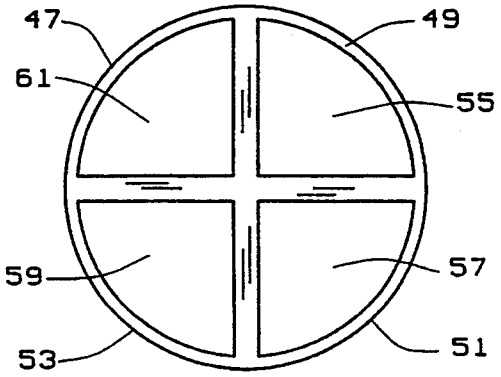
FIG. 33 is a top plan view of the vacuum/blower valve in blowing operation.
Figure 36:
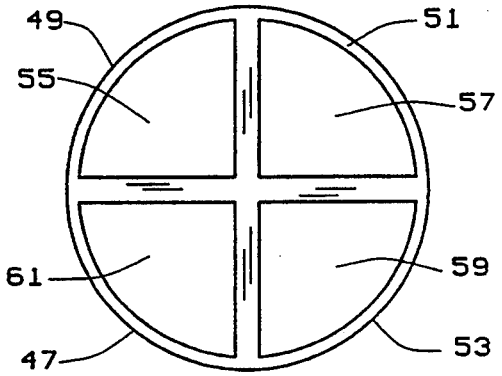
FIG. 36 is a top plan view of the vacuum/blower valve in vacuum operation.

In the vacuum-parallel mode of operation, the split air intake I, as best illustrated in FIG. 5, 20 and 23 of the drawings, results in low pressure/high air flow through the air flow channels, with low pressure/high air flow intake air I introduced into the vacuum/blower device 1.

In the blower mode of operation shown in FIG. 6–8 of the drawings, exhaust air E is exhausted through the tube 25, while intake air I is drawn into through the intake opening or openings 19 between the upper cover 13 and lower lid 15. Thus, the only change from the previously described vacuum mode is in the area of the vacuum/blower or intake/exhaust valve 29.

As shown in FIGS. 14–16 and 31–33 of the drawings, when the manual actuator 31 of the vacuum/blower or intake/exhaust valve 29 is moved to the blower B position, exhaust air E passes through the lateral quadrant 51 and the vertical quadrants 57, 59, constituting a third flow-through passageway, prior to being exhausted through the hollow tube 25 as a blower air pressure. Intake air I, on the other hand, is drawn into the opening or openings 19 between the upper cover 13 and lower lid 15, and then is directed into the left hand side air flow channel 143, and finally vertical quadrants 61, 55, constituting a fourth flow-through passageway, of the valve 29 into the container 5.

In the blower-series mode of operation shown in FIGS. 7, 18–20 and 31–33 of the drawings, it will be seen that the intake air I and exhaust air E flows through the various air flow channel in the same manner as the air flow of the vacuum-series mode, except in the reversal of air through the vacuum/blower or intake/exhaust valve 29, as previously described.

Similarly, in the blower-parallel mode of operation shown in FIGS. 8, 21–24 and 28–30 of the drawings, except for the initial entry through and exit from the vacuum/blower or intake/exhaust valve 29, the air flow through the air flow channels, in cooperation with the upper and lower blower wheels 43, 45, is the same as the vacuum-parallel mode air flow shown in FIG. 5 of the drawings.

As can be seen from the above discussion, the variable high/low vacuum/blower device 1 of the present invention provides an interchangeable vacuum/blower device with high pressure/low air flow or low pressure/high air flow, when operated as either a vacuum cleaner or blower device. The unique construction and features of the present invention provides a selectively changeable or adjustable vacuum/blower device for positive air outflow with variable adjustment through zero to a negative air inflow, while only using a single inlet, outlet port in the vacuum or blowing operation.

Figure 37:
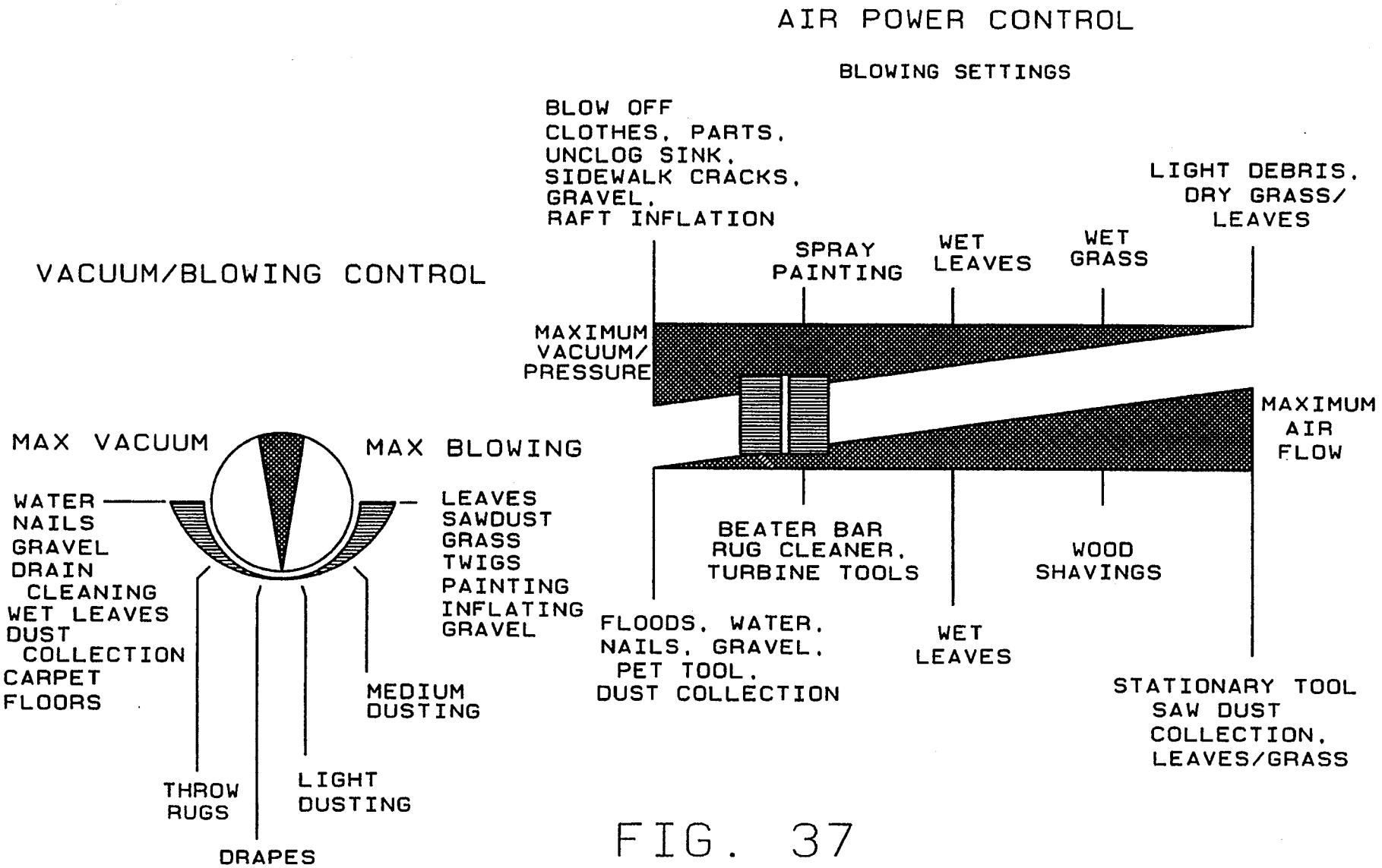
FIG. 37 is a chart explaining operation of the vacuum/blower device for adjusting vacuum/blowing control and air flow or power control for disposing of a wide variety of different elements, as indicated.

Some of the many practical applications of the variable high/low vacuum/blower device 1 of the present invention are shown in FIG. 37 of the drawings. Note at the left hand side of FIG. 37 the variations available from maximum vacuum through zero to maximum blowing, and the different types of elements that can be treated or disposed of, as may be desired. At the right hand side of FIG. 37, the variations in air power or air flow control are shown from maximum vacuum/pressure to maximum air flow, with the types of elements to be treated or disposed of also indicated.

In view of the above, it will be seen that the several objects and features of this invention are achieved and other advantageous results obtained. As various changes could be made in the above constructions without departing from the scope of the invention, it is intended that all matter contained in the above description or shown in the accompanying drawings shall be interpreted as illustrative and not in a limiting sense.

I claim:

1. A vacuum/blower device having vacuum/blower means for engaging debris comprising:

a housing having air flow channels;

air inlet/outlet means extending through said housing and connected to said air flow channels;

means for establishing high pressure/low air flow in said air flow channels;

means for establishing low pressure/high air flow in said air flow channels; and means for selectively changing the air pressure and air flow in said air flow channels from high pressure/low air flow to low pressure/high air flow when operated as a vacuum device and also as a blower device.

2. The vacuum/blower device as defined in claim 1 wherein the means for selectively changing the air flow in said air flow channels from high pressure/low air flow to low pressure/high air flow comprises valve means.

3. The vacuum/blower device as defined in claim 2 wherein said means for creating air flow through said air flow channels includes motor driven blower wheel means.

4. The vacuum/blower device as defined in claim 3 wherein said valve means cooperates with said motor driven blower wheel means to provide the high pressure/low air flow or low pressure/high air flow operation.

5. The vacuum/blower device as defined in claim 4 including second valve means for selectively changing the air flow through said air inlet/outlet means to enable said variable air flow device to operate as either a vacuum or blower device.

6. A vacuum/blower device having vacuum/blower means including:

a housing having air flow channels;

air inlet/outlet means extending through said housing and connected to said air flow channels;

means for establishing high pressure/low air flow in said air flow channels;

means for establishing low pressure/high air flow in said air flow channels;

means for selectively changing the air pressure and air flow in said air flow channels from high pressure/low air flow to low pressure/high air flow when operated as a vacuum device and also as a blower device.

7. The vacuum/blower device as defined in claim 6 wherein said means for changing the air flow through said air inlet/outlet means includes an air inlet/outlet port and air exhaust/intake means both being connected to said air flow channels and extending through the housing, said air exhaust/intake means exhausting air when air is introduced into said air inlet/outlet port for operating said device as a vacuum cleaner, said air exhaust/intaking means intaking air when air is directed out through said inlet/outlet port for operating said device as a blower.

8. The vacuum/blower device as defined in claim 7 wherein the means for selectively changing the air flow in said air flow channels from high pressure/low air flow to low pressure/high air flow comprises valve means.

9. The vacuum/blower device as defined in claim 8 wherein said means for selectively changing the air flow through said air inlet/outlet port to provide either a vacuum or blower device includes second valve means.

10. The vacuum/blower device as defined in claim 9 wherein said first and second valve means are also manually operable.

11. The vacuum/blower device as defined in claim 10 wherein said first and second valve means are also manually operable.

12. The vacuum/blower device as defined in claim 11 wherein said means for creating air flow through said air flow channels includes motor driven blower wheel means.

13. The vacuum/blower device as defined in claim 12 wherein said valve means cooperates with said motor driven blower wheel means to provide the high pressure/low air flow or low pressure/high air flow operation.

14. The vacuum/blower device as defined in claim 13 wherein said second valve means also cooperates with said motor driven blower wheel means to change the device from a vacuum cleaner to a blower device.

15. A vacuum/blower device having vacuum/blower means including:

a housing;

an air inlet/outlet port extending through the housing;

a motor operatively connected to means within the housing for creating air flow in and through said housing;

means for establishing high pressure/low air flow in said air flow channels;

means for establishing low pressure air flow in said air flow channels;

means for selectively changing the air pressure and air flow in said air flow channels from high pressure/low air flow operation to low pressure/high air flow operation when operated as a vacuum device and also as a blower device;

means for selectively changing said air flow through said air inlet/outlet port from a positive air outflow through zero to a negative air inflow; and air exhaust/intake means also extending through said housing for exhausting air when there is a negative air inflow and for intaking air when there is a positive air outflow.

16. The vacuum/blower device as defined in claim 15 wherein said means for changing the air flow from high pressure/low air flow to low pressure/high air flow operation comprises a first independently operable valve means.

17. The vacuum/blower device as defined in claim 16 wherein said means for changing the air flow from a positive air outflow through zero to a negative air inflow comprises a second independently operable valve means.

18. The vacuum/blower device as defined in claim 17 wherein said first independently operable valve means is adjustable to variable positions from high pressure/-low air flow through zero to low pressure/high air flow.

19. The vacuum/blower device as defined in claim 18 wherein said second independently operable valve means is adjustable to variable positions from maximum vacuum through zero to maximum blowing.

20. The vacuum/blower device as defined in claim 19 wherein said first valve means includes a manually operable actuator mounted on an exterior surface of said housing for access by a user.

21. The vacuum/blower device as defined in claim 20 wherein said second valve means also includes a manually operable actuator mounted on an exterior surface of said housing for access by a user.

22. The vacuum/blower device as defined in claim 21 wherein said means for creating air flow in and through said housing comprises motor driven blower wheel means operating in conjunction with said first and second valve means.

23. A vacuum/blower device having vacuum/blower means including:

a housing having an air inlet/outlet port extending through the housing; said housing having air flow channels connected to said port;

a motor disposed within said housing;

blower wheel means operated by said motor for directing high pressure/low air flow or low pressure/high air flow through said air flow channels dependent on the position of first valve means;

said first valve means connected to said air flow channels for changing the air pressure and air flow from a high pressure/low air flow to a low pressure/-high air flow operation when operated as a vacuum device and also as a blower device;

second valve means connected to said air flow channels for changing the air flow through said air flow inlet/outlet port from a positive air flow through zero to a negative air inflow;

said vacuum/blower device operating as either a vacuum with a negative air inflow or as a blower with a positive air outflow dependent on the position of said second valve means; and air exhaust/intake means also extending through said housing for exhausting air when operated as a vacuum device and for intaking air when operated as a blower device.

24. The vacuum/blower device as defined in claim 23 wherein said blower wheel means includes first and second blower wheels that are connected to said air flow channels and operate in conjunction with said first and second valve means to operate as either a vacuum or blower device with high pressure/low air flow or low pressure/high air flow.

25. The variable air flow device as defined in claim 1 wherein the means for selectively changing the air flow in said air flow channels includes means for adjusting the air flow through a range of variable adjustment from high pressure/low air flow through zero to low pressure/high air flow.

* * * * *